US006092656A

United States Patent [19]

Ernst

[11] Patent Number: 6,092,656

[45] Date of Patent: Jul. 25, 2000

[54] WRENCH SOCKET HOLDER WITH LOCKING MEMBER

[76] Inventor: Gregory R. Ernst, 15735 SE. Bartell Rd., Boring, Oreg. 97009

[21] Appl. No.: 09/322,306

[22] Filed: May 28, 1999

[51] Int. Cl.[7] ..... B65D 85/28

[52] U.S. Cl. ..... 206/378; 206/493; 206/806; 211/70.6

[58] Field of Search ..... 206/378, 376, 206/493, 372, 480, 483, 806, 303; 211/70.6

[56] References Cited

U.S. PATENT DOCUMENTS

| | | | |
|---|---|---|---|
| 1,538,621 | 5/1925 | Chase | 211/70.6 |
| 4,043,453 | 8/1977 | Greenlee . | |
| 5,036,975 | 8/1991 | Chow | 206/376 |
| 5,044,591 | 9/1991 | Huang | 248/317 |
| 5,080,240 | 1/1992 | Williams | 211/70.6 |
| 5,398,823 | 3/1995 | Anders . | |
| 5,467,874 | 11/1995 | Whitaker | 206/378 |
| 5,740,911 | 4/1998 | Chou | 206/378 |
| 5,967,340 | 10/1999 | Kao | 211/70.6 |
| 5,975,297 | 11/1999 | Kao | 206/378 |

*Primary Examiner*—Paul T. Sewell
*Assistant Examiner*—Nhan T. Lam
*Attorney, Agent, or Firm*—James D. Givnan, Jr.

[57] ABSTRACT

Wrench sockets are supported on an elongate base by socket holders. A locking member restricts axial displacement of each socket preventing socket separation from each holder. Arms on the locking member protrude into the sockets to contribute to socket retention as do edge surfaces on the locking member. Flexible arms secure the locking member to the base while permitting socket removal upon displacement by the end user.

4 Claims, 1 Drawing Sheet

WRENCH SOCKET HOLDER WITH LOCKING MEMBER

BACKGROUND OF THE INVENTION

The present invention concerns a holder on which several wrench sockets may be displayed and carried in a locked manner.

To promote the sale of merchandise it is important to display same enabling close inspection by the prospective purchaser which unfortunately increases the risk of theft particularly if the article is costly and easily concealed by a shoplifter. Wrench sockets fall within this category.

U.S. Pat. No. 4,043,453 wherein individual sockets are retained on a support by an arm on the support having a socket engageable catch which requires a tool for socket release.

U.S. Pat. No. 5,348,823 discloses several wrench socket holders on a base with the sockets held in place simply by spring biased ball elements.

SUMMARY OF THE PRESENT INVENTION

The present invention is embodied in a wrench socket holder permitting several sockets to be displayed for sale with the sockets locked in place on the holder.

A multitude of wrench sockets locked in place on the holder renders the holder of a size not readily concealed on the person to deter theft while permitting a prospective buyer to closely examine socket details. A placard may also be included on the holder to further enhance sale prospects. After sale, the present holder may be utilized as a socket carrier for transport of a socket set to a job site and for subsequent storage of the sockets.

Important objectives of the present holder include the provision of a holder on which several wrench sockets may be displayed in a retail establishment without risk of pilferage as each socket is secured to a base of the holder which is of a size to discourage shoplifting; the provision of a socket wrench older which may be used, after purchase, to store and carry wrench sockets in an orderly fashioin; the provision of a wrench socket holder which includes an open area for mounting a sale promoting placard and, after sale, a handgrip for convenient carrying of the holder and a socket set thereon.

DETAILED DESCRIPTION OF THE PREFERRED EMBODIMENTS

Figure 1:
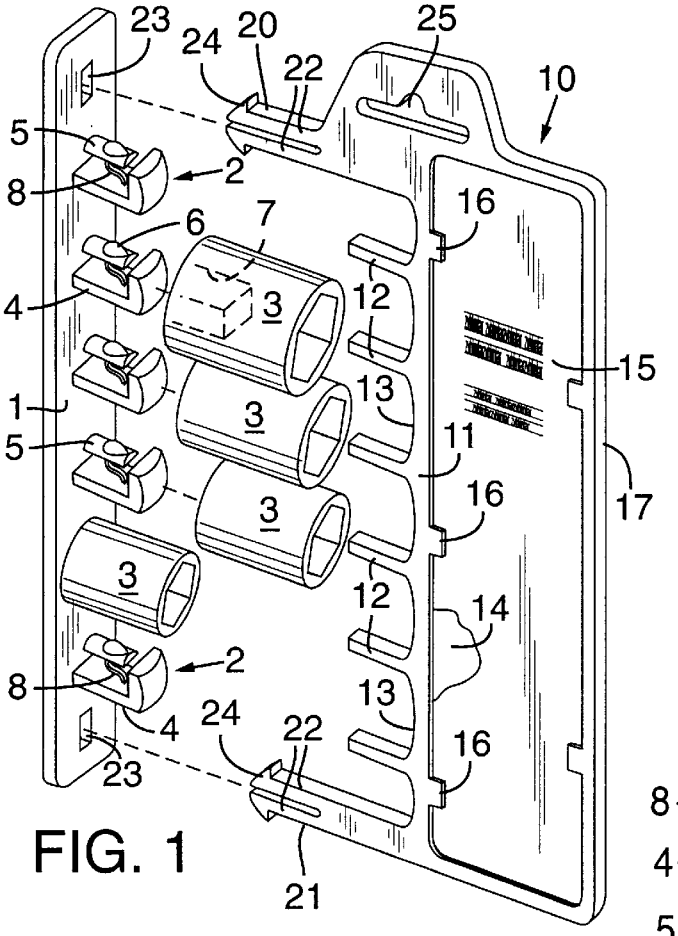
FIG. 1 is a perspective exploded view of the holder.
Figure 2:
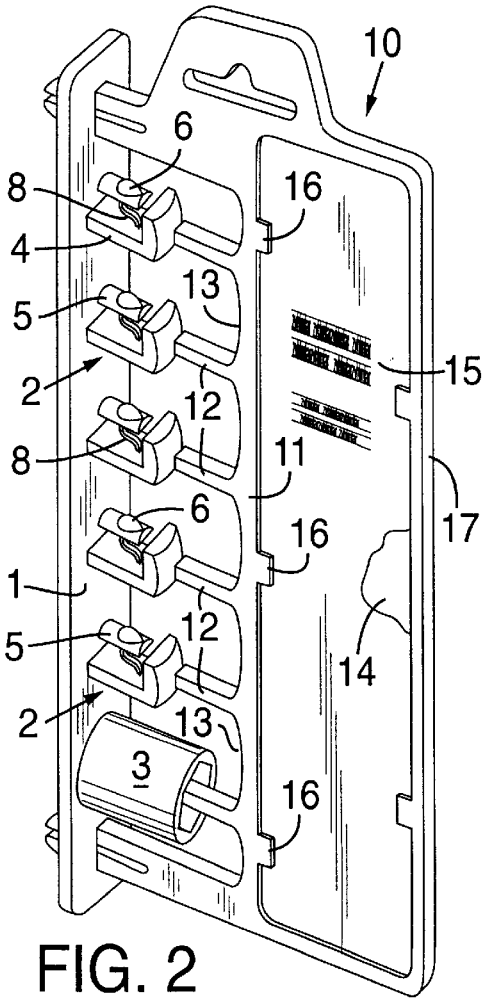
FIG. 2 is a perspective view of the holder with all but one wrench socket removed for purpose of illustration.

With continuing attention to the accompanying drawings, the reference numeral 1 indicates the base of the present holder.

Base 1 is elongate and carries a multitude of socket holders generally at 2 spaced at intervals therealong to receive wrench sockets 3 in an inserted manner. The socket holders 2 are the subject of a co-pending application. Each holder includes a post 4 and preferably a yieldable arm 5 having a boss 6 thereon for seating in a recess defined by an inner wall 7 of a wrench socket 3. Typically wrench sockets define such a recess for the reception of a ball element on the drive stud of a ratchet wrench. A spring element 8 urges socket holder arm 5 and the boss thereon into engagement with the wrench socket defined recess. While a preferred socket holder is shown at 2 other types of socket holders may be utilized, as for example, a socket holder in the shape of post 4.

A locking member generally at 10 is also of elongate configuration having a first lengthwise extending member 11 from which a series of arms 12 extend each in respective axial alignment with a wrench socket holder 2. With a wrench socket 3 in place on each holder 2 the arms 12 each terminate in a socket. Intermediate the arms 12 are edges 13 of the locking member which are opposite the socket ends and limit axial travel of the socket. The foregoing permits inspection of each socket but prevents socket separation from a socket holder 2 upon attachment of locking member 10 as later described. Arms 12 prevent a socket 3, when raised from a holder 2, from being removed from the present invention.

Preferably locking member 10 defines an open area 14 in which a printed placard or cardboard sheet 15 may be installed. One suitable manner for retention of placket 15 may be by lugs 16 extending into open area 14 on both sides of an installed placard 15 to confine the placard in place until removed. Upon such removal the placard a lengthwise extending member 17 may serve as a hand grip for carrying of the holder and sockets therein.

Locking member 10 includes lock means at 20 and 21 with flexible arms at 22 which flex toward one another enabling passage through slots 23 in base 1. Subsequent to such insertion arm carried detents at 24 serve to prevent extraction of flexible arms 22 from base 1. An opening 25 on locking member 10 receives an arm (not shown) of a store display rack.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

1. A holder for wrench sockets including, an elongate base having posts at spaced apart intervals therealong for individual reception of wrench sockets, a locking member including locking means for retention of the locking member on said base, edge surfaces on the locking member substantially perpendicular and proximate said posts and restricting axial separation of the wrench sockets away from their respective posts, a series of arms on the locking member each in individual and substantially axial alignment respectively with one of said posts to prevent lateral separation of a wrench socket from the holder.

2. The holder claimed in claim 1 wherein said lock means includes flexible members insertably engageable with said base.

3. The holder claimed in claim 2 wherein said locking member defines an open area, a placard in place in said open area.

4. The holder claimed in claim 1 wherein each arm of said series of arms are contiguous with said edge surfaces of the locking member, each of said arms terminating respectively at their distal ends adjacent one of said posts.

* * * * *